US007579949B2

(12) United States Patent
Chiu

(10) Patent No.: US 7,579,949 B2
(45) Date of Patent: Aug. 25, 2009

(54) ANTI-THEFT SYSTEM AND CONTAINER SAFEGUARDED BY THE SAME

(75) Inventor: Chien-Sheng Chiu, Taichung (TW)

(73) Assignee: Syris Technology Corp., Taichung (TW)

( * ) Notice: Subject to any disclaimer, the term of this patent is extended or adjusted under 35 U.S.C. 154(b) by 398 days.

(21) Appl. No.: 11/447,828

(22) Filed: Jun. 6, 2006

(65) Prior Publication Data

US 2007/0279223 A1 Dec. 6, 2007

(51) Int. Cl.
*G08B 13/18* (2006.01)

(52) U.S. Cl. ..... 340/552; 340/545.6

(58) Field of Classification Search ... 340/545.6–545.9, 340/569, 570, 5.73

See application file for complete search history.

(56) References Cited

U.S. PATENT DOCUMENTS 6,753,781 B2 * 6/2004 Radomsky et al. ..... 340/573.4
2005/0280546 A1 * 12/2005 Ganley et al. ..... 340/573.4

* cited by examiner

*Primary Examiner*—Daniel Wu
*Assistant Examiner*—Shirley Lu
(74) *Attorney, Agent, or Firm*—The Webb Law Firm

(57) ABSTRACT

An anti-theft system includes a detecting device, a processing unit, and an alarm unit. The detecting device includes a first detecting unit that is operable so as to transmit a first signal, and a second detecting unit that transmits a second signal to the first detecting unit in response to the first signal. The processing unit verifies the second signal, and enables the first detecting unit to continue to transmit the first signal upon successful verification of the second signal. The alarm unit generates an alarm signal upon unsuccessful verification of the second signal. A container that is safeguarded by the anti-theft system is also disclosed.

13 Claims, 6 Drawing Sheets

ANTI-THEFT SYSTEM AND CONTAINER SAFEGUARDED BY THE SAME

BACKGROUND OF THE INVENTION

1. Field of the Invention

The invention relates to an anti-theft system, and a container that includes the anti-theft system for safeguarding the same.

2. Description of the Related Art

Typically, a padlock is employed to fasten first and second doors of a cargo container for deterring occurrence of a burglary. However, the padlock can be easily broken with the use of a tool that is available in the marketplace.

SUMMARY OF THE INVENTION

Therefore, the object of the present invention is to provide an anti-theft system, and a container that includes the anti-theft system so as to discourage theft.

According to one aspect of the present invention, an anti-theft system comprises a detecting device, a processing unit, and an alarm unit. The detecting device includes first and second detecting units each capable of signal transmission and reception. The first detecting unit is operable so as to transmit a first signal for reception by the second detecting unit. The second detecting unit transmits a second signal for reception by the first detecting unit in response to the first signal received from the first detecting unit. The processing unit is coupled electrically to the first detecting unit, and is operable so as to verify the second signal received by the first detecting unit and so as to enable the first detecting unit to continue to transmit the first signal for reception by the second detecting unit upon successful verification of the second signal received by the first detecting unit. The alarm unit is coupled electrically to and is controlled by the processing unit to generate an alarm signal upon unsuccessful verification of the second signal.

According to another aspect of the present invention, a container comprises a container body and an anti-theft system. The container body includes a container frame with an open side, and a door unit for closing and opening the open side of the container frame. The anti-theft system includes a detecting device, a processing unit, and an alarm unit. The detecting device is mounted on the container body, and includes first and second detecting units each capable of signal transmission and reception. The first detecting unit is operable so as to transmit a first signal for reception by the second detecting unit. The second detecting unit is operable so as to transmit a second signal for reception by the first detecting unit in response to the first signal received from the first detecting unit when the door unit closes the open side of the container frame. The processing unit is coupled electrically to the first detecting unit, and monitors reception of the second signal by the first detecting unit and controls transmission of the first signal by the first detecting unit. The alarm unit is coupled electrically to and is controlled by the processing unit to generate an alarm signal upon detection by the processing unit of irregularity in reception of the second signal by the first detecting unit.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
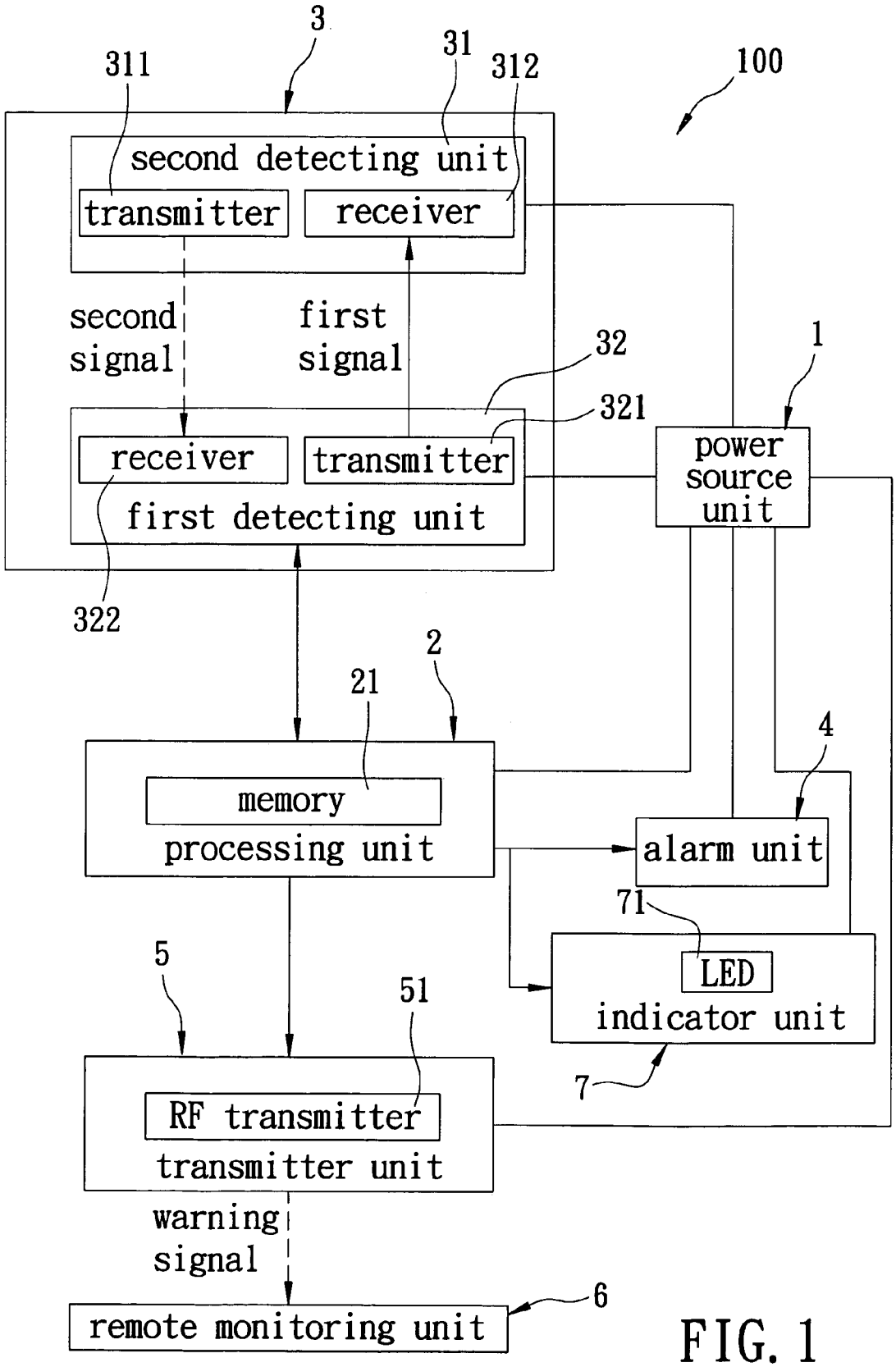
FIG. 1 is a schematic block diagram of the preferred embodiment of an anti-theft system according to the present invention.

Before the present invention is described in greater detail, it should be noted that like elements are denoted by the same reference numerals throughout the disclosure.

Referring to FIG. 1, the preferred embodiment of an anti-theft system 100 according to this invention is shown to include a detecting device 3, a processing unit 2, and an alarm unit 4.

The detecting device 3 includes first and second detecting units 32, 31 each capable of signal transmission and reception. In particular, each of the first and second detecting units 32, 31 includes a transmitter 321, 311 and a receiver 322, 312. The transmitter 321 of the first detecting unit 32 is operable so as to transmit a first signal for reception by the receiver 312 of the second detecting unit 31. On the other hand, the transmitter 311 of the second detecting unit 31 is operable so as to transmit a second signal for reception by the receiver 322 of the first detecting unit 32 in response to the first signal received from the transmitter 321 of the first detecting unit 32. In this embodiment, the transmitter 321, 311 of each of the first and second detecting units 32, 31 is an infrared transmitter, and the receiver 322, 312 of each of the first and second detecting units 32, 31 is an infrared receiver.

The processing unit 2 is connected electrically to the first detecting unit 32, and is operable so as to verify the second signal received by the receiver 322 of the first detecting unit 32, so as to monitor reception of the second signal by the receiver 322 of the first detecting unit 32, so as to control transmission of the first signal by the transmitter 321 of the first detecting unit 32, and so as to enable the transmitter 321 of the first detecting unit 32 to continue to transmit the first signal for reception by the receiver 312 of the second detecting unit 31 upon successful verification of the second signal received by the receiver 322 of the first detecting unit 32. In this embodiment, the processing unit 2 includes a memory 21 for storing an identification code, and verifies the second signal received by receiver 322 of the first detecting unit 32 by comparing the second signal to the identification code stored in the memory 21 thereof.

The alarm unit 4 is connected electrically to and is controlled by the processing unit 2 to generate an alarm signal upon unsuccessful verification of the second signal. In this embodiment, the alarm unit 4 is a buzzer.

The anti-theft system 100 further includes a transmitting unit 5 connected electrically to and controlled by the processing unit 2 to transmit wirelessly a warning signal upon unsuccessful verification of the second signal. In this embodiment, the transmitting unit 5 includes a radio frequency (RF) transmitter 51.

The anti-theft system 100 further includes a remote monitoring unit 6 for receiving the warning signal wirelessly transmitted by the transmitting unit 5, for recording the time the warning signal was received, and for generating a warning message that corresponds to the warning signal. As such, status of an object to which the anti-theft system 100 is applied can be monitored from afar.

The anti-theft system 100 further includes an indicator unit 7 connected electrically to and controlled by the processing unit 2 to provide a visual indication upon unsuccessful verification of the second signal. In this embodiment, the indicator unit 7 includes a light-emitting diode (LED) 71 that emits a red light.

The anti-theft system 100 further includes a power source unit 1 that is connected to the first and second detecting units 32, 31 of the detecting device 3, the processing unit 2, the alarm unit 4, the transmitting unit 5, and the indicator unit 7 for supplying electrical power thereto. In this embodiment, the power source unit 1 includes a pair of 1.5 Volts battery cells (not shown).

Figure 2:
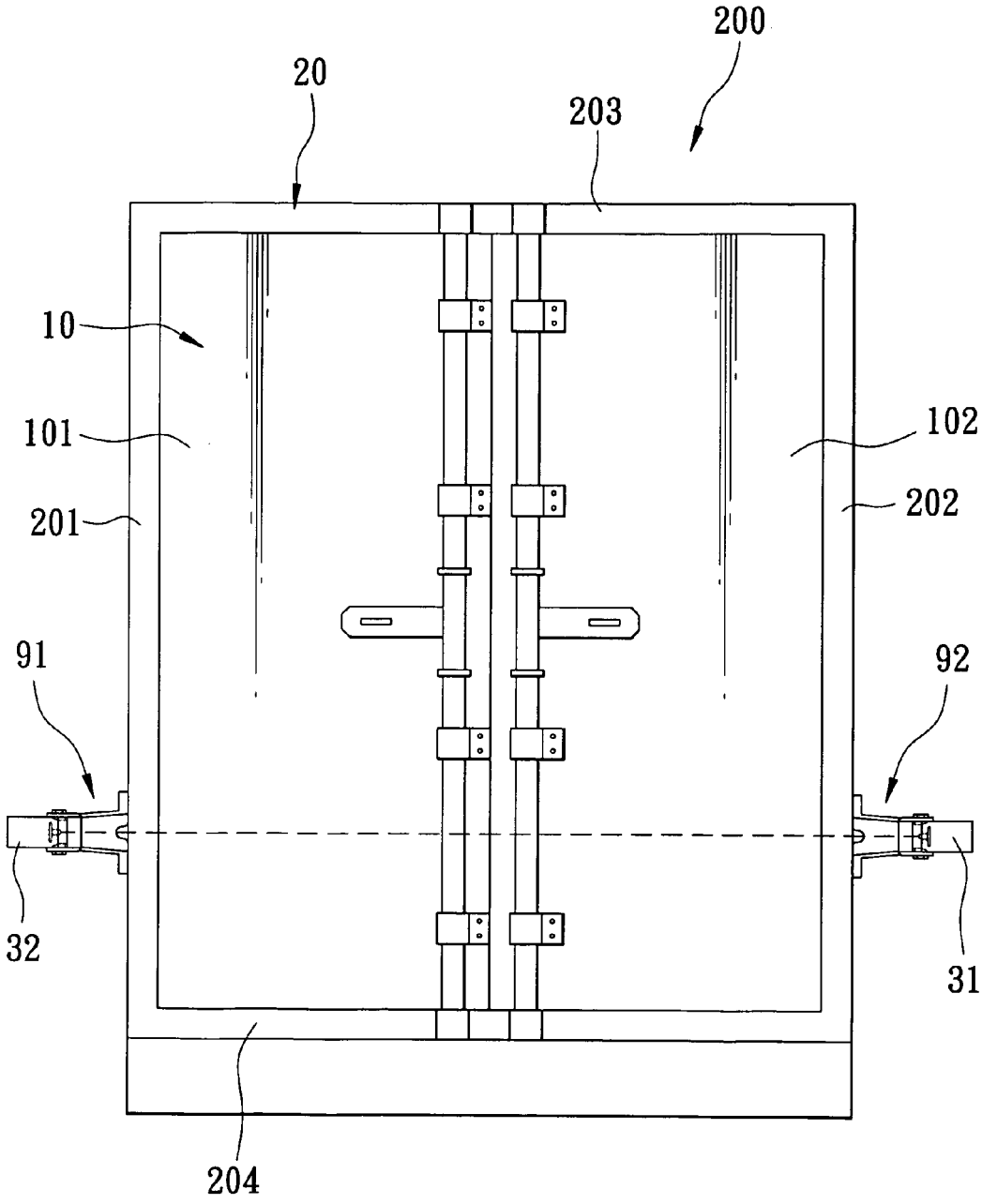
FIG. 2 is a schematic view of the first preferred embodiment of a container according to the present invention.

Referring to FIG. 2, the first preferred embodiment of a container, such as a cargo container, according to this invention includes a container body 200 and the anti-theft system 100.

In this embodiment, the anti-theft system 100 safeguards the container body 200 from burglars (not shown), in a manner that will be described hereinafter.

The container body 200 includes a container frame 20 and a door unit 10. The container frame 20 defines left and right open sides (not shown), and includes left and right frame parts 201, 202 and top and bottom frame parts 203, 204 that cooperatively define the left and right open sides. The door unit 10 includes first and second doors 101, 102, each of which is pivoted to a respective one of the left and right frame parts 201, 202 of the container frame 20 and each of which is operable to close and open a respective one of the left and right open sides of the container frame 20.

Figure 3:
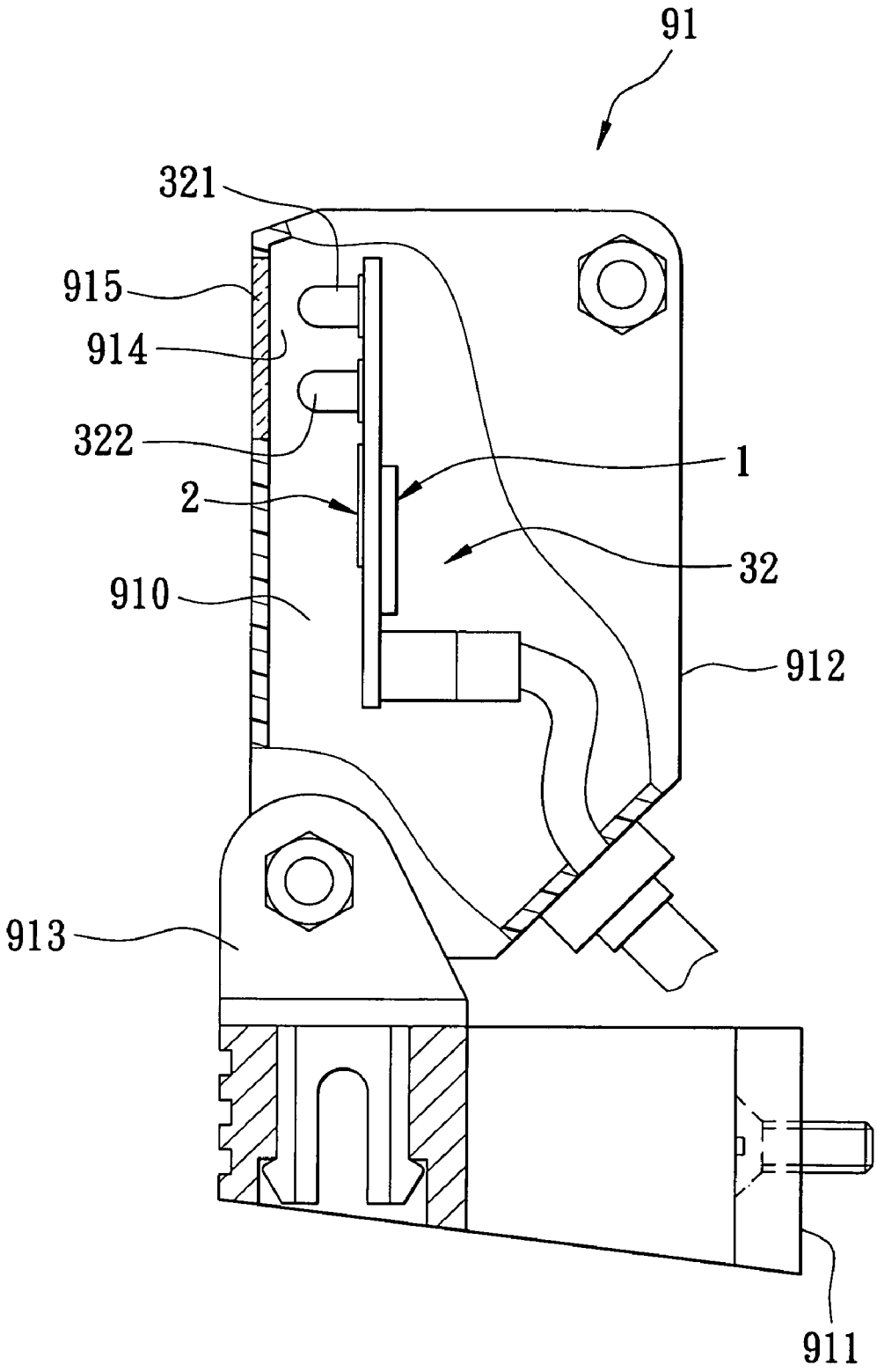
FIG. 3 is a partly sectional schematic view to illustrate a mounting seat unit of the first preferred embodiment according to the present invention.
Figure 4:
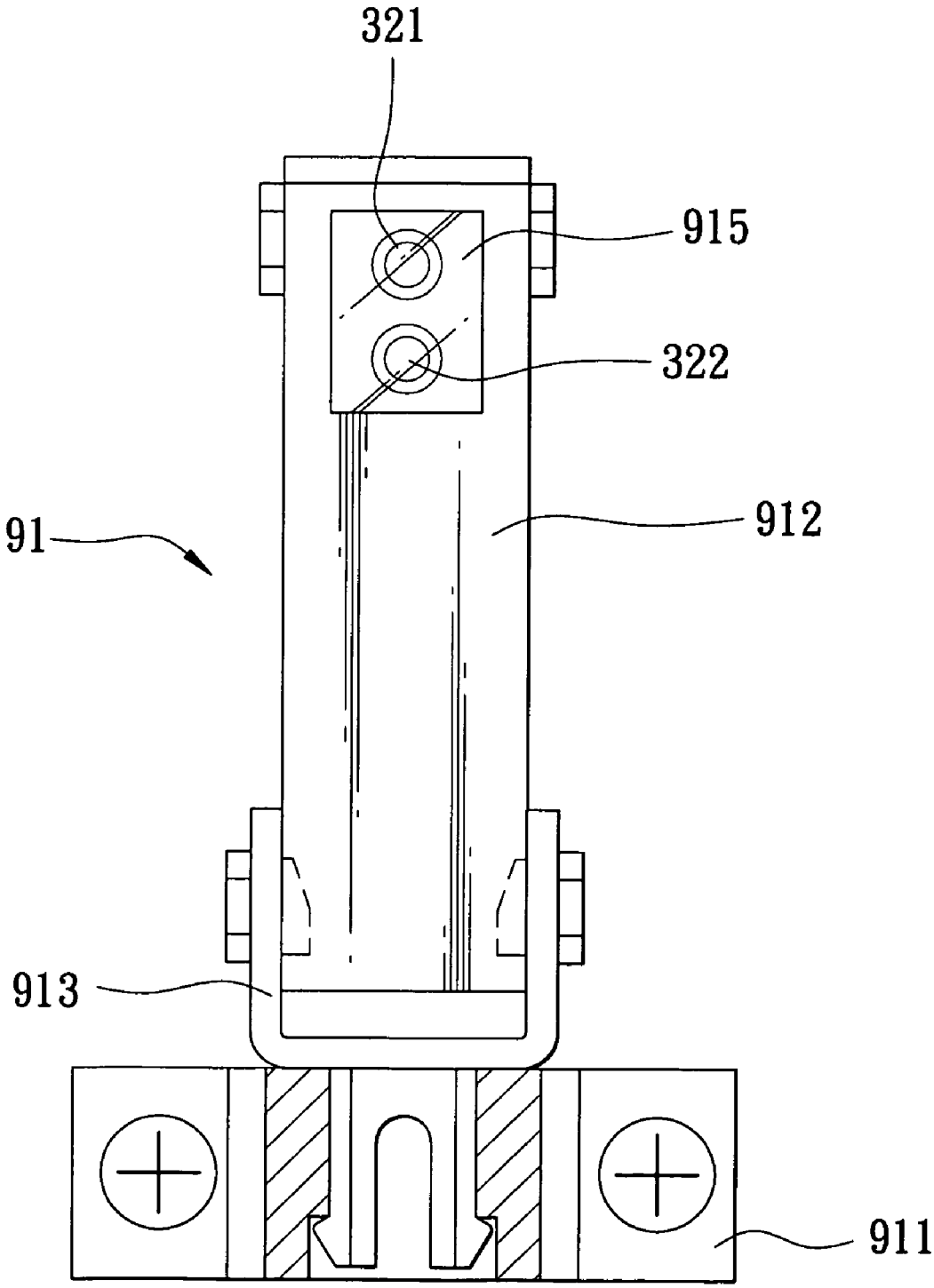
FIG. 4 is a partly sectional schematic view to illustrate a window covered with a light transmissible member of the mounting seat unit of the first preferred embodiment.

In this embodiment, each of the first and second detecting units 32, 31 is disposed externally of the container body 200, and is mounted on a respective one of the left and right frame parts 201, 202 of the container frame 20. In particular, with further reference to FIGS. 3 and 4, the anti-theft system 100 further includes first and second mounting seat units 91, 92, each of which includes first, second, and third seat modules 911, 912, 913 (only the first mounting seat unit 91 is shown in FIGS. 3 and 4). The first seat module 911 of each of the first and second mounting seat units 91, 92 is mounted on the respective one of the left and right frame parts 201, 202 of the container frame 20. The second seat module 912 of each of the first and second mounting seat units 9 confines an accommodating space 910, and is formed with a window 914 that is in spatial communication with the accommodating space 910. Each of the first and second detecting units 32, 31 is mounted in the accommodating space 910 in a respective one of the second seat modules 912 such that the transmitter 321, 311 and the receiver 322, 312 of each of the first and second detecting units 32, 31 face the window 914 of the respective one of the second seat modules 912, as best shown in FIG. 4. Each of the first and second mounting seat units 91, 92 further includes a light transmissible shield 915 that covers the window 914 of a respective one of the second seat modules 912. The third seat module 913 of each of the first and second mounting seat units 91, 92 is connected detachably to a respective one of the first seat modules 911, and is used to connect pivotally a respective one of the second seat modules 912 to the respective one of the first seat modules 911. The construction as such permits adjustment of the second seat modules 912 at an arbitrary angle relative to the respective one of the first seat modules 911.

It is noted that, in this embodiment, the processing unit 2 is mounted in the accommodating space 910 in the second seat module 912 of the first mounting seat unit 91.

In operation, when the first and second doors 101, 102 of the door unit 10 close the left and right open sides of the container frame 20, the first and second detecting units 32, 31 have a line-of-sight therebetween such that the transmitter 311 of the second detecting unit 31 transmits the second signal for reception by the receiver 322 of the first detecting unit 32 in response to the first signal received from the transmitter 321 of the first detecting unit 32. Moreover, the processing unit 2 enables the transmitter 321 of the first detecting unit 32 to continue to transmit the first signal for reception by the receiver 312 of the second detecting unit 31 upon successful verification of the second signal received by the first detecting unit 32. At this time, when either one of the first and second doors 101, 102 of the door unit 10 opens the left or right open side of the container frame 20, the processing unit 2 detects irregularity in the reception of the second signal by the first detecting unit 32. This results in unsuccessful verification of the second signal by the processing unit 2. As a consequence, the processing unit 2 controls the alarm unit 4 to generate the alarm signal, and the transmitting unit 5 to transmit the warning signal to the remote monitoring unit 6.

Figure 5:
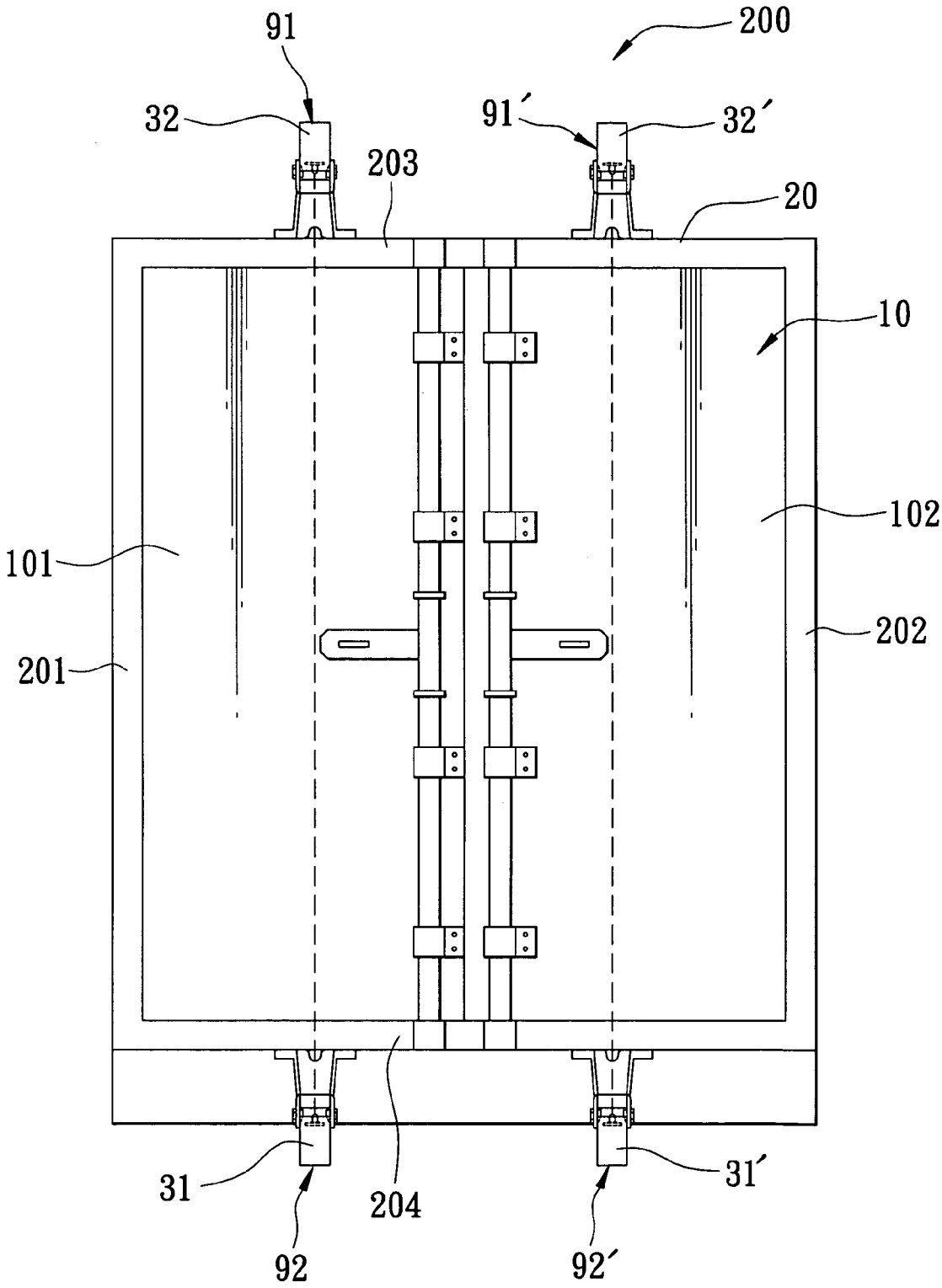
FIG. 5 is a schematic view of the second preferred embodiment of a container according to the present invention.

FIG. 5 illustrates the second preferred embodiment of a container 200 according to this invention. When compared to the previous-embodiment, each of the first and second detecting units 32, 31 is mounted on a respective one of the top and bottom frame parts 203, 204 of the container frame 20. In particular, the first seat module 911 of each of the first and second mounting seat units 91, 92 is mounted on a respective one of the top and bottom frame parts 203, 204 of the container frame 20 and is disposed adjacent to the first door 101. Each of the first and second detecting units 32, 31 is mounted in the accommodating space 910 in the second seat module 912 of a respective one of the first and second mounting seat units 32, 31.

The anti-theft system 100 further includes third and fourth mounting seat units 91', 92'. Since the constructions of the third and fourth mounting seat units 91', 92' are similar to those described hereinabove in connection with the first and second mounting seat units 91, 92, respectively, a detailed description of the same will be dispensed with herein for the sake of brevity. The first seat module of each of the third and fourth mounting seat units 91', 92' is mounted on a respective one of the top and bottom frame parts 203, 204 of the container frame 20 and is disposed adjacent to the second door 102.

The detecting device of the anti-theft system 100 further includes third and fourth detecting units 32', 31'. Since the construction and operation of the third and fourth detecting units 32', 31' are similar to those described hereinabove in connection with the first and second detecting units 32, 31, respectively, a detailed description of the same will be dispensed with herein for the sake of brevity. Each of the third and fourth detecting units 32', 31' is mounted in the accommodating space in the second seat module of a respective one of the third and fourth mounting seat units 91', 92'.

In this embodiment, when either one of the first and second doors 101, 102 is opened, the line-of-sight between the corresponding pair of the first and second detecting units 32, 31 or third and fourth detecting units 32', 31' is interrupted such that the processing unit 2 associated with the corresponding detecting unit pair detects the aforementioned irregularity in signal reception.

Figure 6:
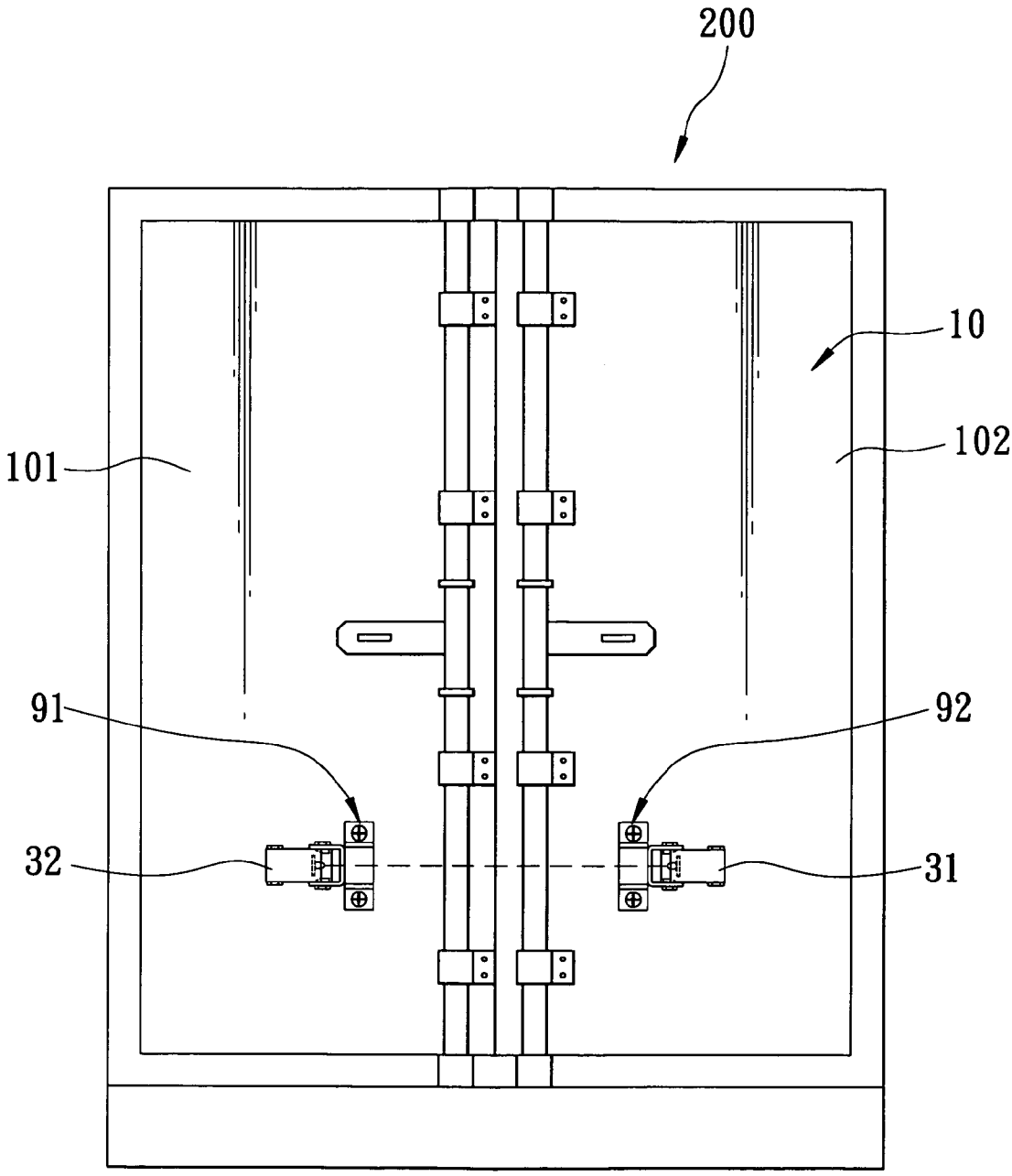
FIG. 6 is a schematic view of the third preferred embodiment of a container according to the present invention

FIG. 6 illustrates the third preferred embodiment of a container 200 according to this invention. When compared to the first embodiment, each of the first and second detecting units 32, 31 is mounted on a respective one of the first and second doors 101, 102. In particular, the first seat module 911 of each of the first and second mounting seat units 91, 92 is mounted on a respective one of the first and second doors 101, 102. Each of the first and second detecting units 32, 31 is mounted in the accommodating space 910 in the second seat module 912 of a respective one of the first and second mounting seat units 91, 92.

Like the first embodiment, the line-of-sight between the first and second detecting units 32, 31 is broken when either one of the doors 101, 102 is opened, thereby resulting in detection by the processing unit 2 of irregularity in reception of the second signal and in failure to successfully verify the second signal.

It is noted that, in an alternative embodiment, each of the first and second detecting units 32, 31 is disposed internally of the container body 200, and is mounted on a respective one of the first and second doors 101, 102. As such, the first and second detecting units 32, 31 are prevented from being altered or damaged by a potential burglar. Moreover, the operations of the first and second detecting units 32, 31 are not affected by weather conditions. Finally, false alarms due to accidental interruption of the signal transmission and reception between the first and second detecting units 32, 31, such as by an animal, can be avoided.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A container, comprising:

a container body including a container frame with an open side, and a door unit for closing and opening said open side of said container frame; and an anti-theft system including a detecting device that is mounted on said container body, and that includes first and second detecting units each capable of signal transmission and reception, said first detecting unit being operable so as to transmit a first signal for reception by said second detecting unit, said second detecting unit being operable so as to transmit a second signal for reception by said first detecting unit in response to the first signal received from said first detecting unit when said door unit closes said open side of said container frame, a processing unit that is coupled electrically to said first detecting unit, and that monitors reception of the second signal by said first detecting unit and that controls transmission of the first signal by said first detecting unit, and an alarm unit that is coupled electrically to and that is controlled by said processing unit to generate an alarm signal upon detection by said processing unit of irregularity in reception of the second signal by said first detecting unit.

2. The container as claimed in claim 1, wherein said container frame includes opposite frame parts at said open side, each of said first and second detecting units being mounted on a respective one of said opposite frame parts of said container frame.

3. The container as claimed in claim 2, wherein said anti-theft system further includes a pair of mounting seat units, each of which is mounted on a respective one of said opposite frame parts of said container frame, each of said first and second detecting units being mounted on a respective one of said mounting seat units, said processing unit being mounted on one of said mounting seat units.

4. The container as claimed in claim 3, wherein each 20 of said mounting seat units includes a first seat module mounted on a respective one of said opposite frame parts of said container frame, and a second seat module coupled pivotally to said first seat module, each of said first and second detecting units being mounted on said second seat module of the respective one of said mounting seat units.

5. The container as claimed in claim 3, wherein said door unit includes first and second doors pivoted to said container frame, each of said first and second detecting units being mounted on a respective one of said first and second doors.

6. The container as claimed in claim 5, wherein said anti-theft system further includes a pair of mounting seat units, each of which is mounted on a respective one of said first and second doors, each of said first and second detecting units being mounted on a respective one of said mounting seat units, said processing unit being mounted on one of said mounting seat units.

7. The container as claimed in claim 6, wherein each of said mounting seat units includes a first seat module mounted on a respective one of said first and second doors, and a second seat module coupled pivotally to said first seat module, each of said first and second detecting units being mounted on said second seat module of the respective one of said mounting seat units.

8. The container as claimed in claim 1, wherein said anti-theft system further includes a transmitting unit coupled electrically to and controlled by said processing unit to transmit wirelessly a warning signal upon detection by said processing unit of irregularity in reception of the second signal by said first detecting unit.

9. The container as claimed in claim 8, further comprising a remote monitoring unit for receiving the warning signal wirelessly transmitted by said transmitting unit.

10. The container as claimed in claim 1, wherein said anti-theft system further includes an indicator unit coupled electrically to and controlled by said processing unit to provide a visual indication of a current state of said door unit.

11. The container as claimed in claim 1, wherein said alarm unit includes a buzzer.

12. The container as claimed in claim 1, wherein said processing unit verifies the second signal received by said first detecting unit by comparing the second signal to an identification code stored therein.

13. An anti-theft system for a container body that includes a container frame with an open side, and a door unit for closing and opening the open side of the container frame, said anti-theft system comprising:

a detecting device adapted for mounting on the container body, said detecting device including first and second detecting units each capable of signal transmission and reception, said first detecting unit being operable so as to transmit a first signal for reception by said second detecting unit, said second detecting unit being operable so as to transmit a second signal for reception by said first detecting unit in response to the first signal received from said first detecting unit when the door unit closes the open side of the container frame;

a processing unit coupled electrically to said first detecting unit, said processing unit monitoring reception of the second signal by said first detecting unit and controlling transmission of the first signal by said first detecting unit; and an alarm unit coupled electrically to and controlled by said processing unit to generate an alarm signal upon detection by said processing unit of irregularity in reception of the second signal by said first detecting unit.

* * * * *